US007736159B1

(12) United States Patent
Effinger, III et al.

(10) Patent No.: US 7,736,159 B1
(45) Date of Patent: Jun. 15, 2010

(54) PLUGGABLE CONNECTOR WITH DIFFERENTIAL PAIRS

(75) Inventors: Robert Peter Effinger, III, Cumberland, PA (US); Megha Shanbhag, Lemoyne, PA (US); Brian Williams, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/419,606

(22) Filed: Apr. 7, 2009

(51) Int. Cl.
*H01R 13/648* (2006.01)

(52) U.S. Cl. ..... 439/108; 439/607.05; 439/607.08

(58) Field of Classification Search ..... 439/108, 439/607.05, 607.08
See application file for complete search history.

(56) References Cited

U.S. PATENT DOCUMENTS

| | | | | |
|---|---|---|---|---|
| 5,766,040 | A | 6/1998 | Naerland et al. | |
| 6,077,122 | A | 6/2000 | Elkhatib et al. | |
| 6,116,965 | A | 9/2000 | Arnett et al. | |
| 6,475,009 | B2 | 11/2002 | Below et al. | |
| 6,595,791 | B2 | 7/2003 | Below et al. | |
| 7,074,066 | B2 | 7/2006 | Pepe | |
| 7,195,518 | B2 | 3/2007 | Bert et al. | |
| 7,207,807 | B2 | 4/2007 | Fogg | |
| 7,234,877 | B2 | 6/2007 | Sedor | |
| 7,275,961 | B2 | 10/2007 | Zauber et al. | |
| 7,303,418 | B2 | 12/2007 | O'Connor | |
| 7,316,584 | B2 | 1/2008 | Mackillop et al. | |
| 7,393,144 | B2 | 7/2008 | Khemakhem et al. | |
| 7,404,739 | B2 * | 7/2008 | Sheilds et al. | 439/607.05 |
| 7,422,484 | B2 * | 9/2008 | Cohen et al. | 439/607.05 |

OTHER PUBLICATIONS

M8/M12 Connector Systems, M8/M12 Connector System Product Line Information http://catalog.tycoelectronics.com, 2 pgs.

* cited by examiner

*Primary Examiner*—Gary F. Paumen

(57) ABSTRACT

A pluggable connector that includes a housing having an inner surface that defines a housing cavity. The housing cavity extends along a central axis to an opening of the housing cavity. The opening is sized and shaped to mate with a mating connector moving along the central axis. The connector also includes a plug insert that is positioned within the housing cavity. The plug insert extends along the central axis and forms contact cavities therein that extend parallel to the central axis. The plug insert has an outer surface that is separated from the inner surface of the housing by a spacing. The connector also includes differential pairs. Each differential pair has two mating contacts that extend parallel to each other along a contact plane of the differential pair and within corresponding contact cavities. The contact planes of at least two adjacent differential pairs are perpendicular to one another.

20 Claims, 5 Drawing Sheets

PLUGGABLE CONNECTOR WITH DIFFERENTIAL PAIRS

BACKGROUND OF THE INVENTION

The invention relates generally to connectors, and more particularly to pluggable connectors for high-speed transmission.

Electrical connectors used to plug a communication cable into an electrical system may include a housing that contains several conductors that form differential pairs. The differential pairs are configured to connect with corresponding differential pairs in a mating connector of the electrical system (e.g. a port) when the pluggable and mating connectors are engaged. However, pluggable connectors that are currently used may have certain limitations due to unwanted electromagnetic coupling between the differential pairs. For example, the operating speeds of M-series pluggable connectors are limited to transmission rates of less than one gigabit per second. If current M-series pluggable connectors were to operate at speeds above one gigabit/s, the unwanted electromagnetic coupling between the differential pairs would harm signal integrity and the performance of the connector. For example, the increase in near-end crosstalk (NEXT), far-end crosstalk, and/or return loss may render the connector unable to meet industry requirements. Furthermore, it may be desirable to improve the insertion loss of such connectors.

Accordingly, there is a need for pluggable connectors that are configured to reduce the negative effects of electromagnetic coupling. There is also a need for pluggable connectors capable of operating at higher speeds and/or obtaining desired performances.

BRIEF DESCRIPTION OF THE INVENTION

In one embodiment, a pluggable connector is provided that includes a housing having an inner surface that defines a housing cavity. The housing cavity includes a base therein and extends along a central axis from the base to an opening of the housing cavity. The opening is sized and shaped to mate with a mating connector moving along the central axis. The connector also includes a plug insert that is positioned within the housing cavity. The plug insert extends from the base along the central axis and forms contact cavities therein that extend parallel to the central axis. The plug insert has an outer surface that is separated from the inner surface of the housing by a spacing. The connector also includes differential pairs that extend from the base along the central axis within the housing cavity. Each differential pair has two mating contacts that extend parallel to each other along a contact plane of the differential pair and within corresponding contact cavities. The contact planes of at least two adjacent differential pairs are perpendicular to one another.

Optionally, the contact plane of one differential pair may be perpendicular to at least two adjacent differential pairs. Also, the differential pairs may be only four differential pairs. The differential pairs may be located with respect to each other so that the connector may operate at a speed of at least one gigabit/s.

In another embodiment, a pluggable connector configured to engage a mating connector is provided. The pluggable connector includes a plug insert that extends along a central axis and forms contact cavities therein. The contact cavities extend parallel to the central axis. The pluggable connector also includes differential pairs that extend along the central axis in the plug insert. Each differential pair includes two mating contacts that extend parallel to each other and within corresponding contact cavities. Also, the pluggable connector includes a grounding member that extends parallel to the central axis. The grounding member is positioned substantially between at least two adjacent differential pairs.

Optionally, the grounding member has a cross-section taken perpendicular to the central axis. The cross-section of the grounding member may have a thickness that decreases as the grounding member extends toward the central axis. Furthermore, the grounding member has a wedge cross-sectional shape. The plug insert may also have a cross-section taken perpendicular to the central axis. The cross-section of the plug insert may have a shape that is substantially circular.

In yet another embodiment, a pluggable connector configured to be inserted into a receptacle connector is provided. The pluggable connector includes a housing that has a wall extending along and surrounding a central axis to form a housing cavity therein. The pluggable connector also has a base within the housing cavity and a plug insert that extends along the central axis from the base and forms contact cavities therein. The contact cavities extend parallel to the central axis. Also, the pluggable connector includes differential pairs that extend from the base along the central axis within the plug insert. Each differential pair includes two mating contacts that extend parallel to each other along a contact plane of the differential pair. The contact planes of adjacent differential pairs being perpendicular to each other. Also, the pluggable connector includes a grounding member that extends parallel to the central axis. The grounding member is positioned substantially between at least two adjacent differential pairs.

DETAILED DESCRIPTION OF THE INVENTION

Embodiments described herein include pluggable connectors having mating contacts that form differential pairs. The differential pairs may be arranged to improve the performance of pluggable connectors with respect to other known connectors. For example, embodiments described herein have differential pairs arranged to reduce, control, or improve upon at least one of insertion loss, near-end crosstalk (NEXT), far-end crosstalk, and return loss. Alternatively or additionally, the pluggable connector may include grounding members that extend alongside and between mating contacts and are configured to isolate the differential pairs. A "pluggable connector." as described herein, is an electrical connector that is configured to mate with another electrical connector (also referred to as a mating connector) through a pluggable engagement. For example, pluggable connectors described herein include plug connectors that have a plug insert configured to be inserted into a cavity of a mating connector. The pluggable connectors may also be receptacle connectors having a cavity that receives a plug insert from a mating connector. Accordingly, a connector assembly of two pluggable connectors may include a first pluggable connector having a plug insert that is inserted into a cavity of a second pluggable connector that has a cavity configured to receive the plug insert.

The pluggable connectors may be electrical connectors, including optoelectronic connectors. When the pluggable connectors are engaged, the pluggable connectors may establish an environmental seal that protects transmissions through the connectors. Also, the pluggable connectors may establish at least one of a communicative and power connection. The communicative connection may be an electrical and/or fiber optic connection. In addition, the pluggable connectors may operate at high-speeds, such as at least one gigabit per second. In other embodiments, the pluggable connectors may transmit at multiple gigabits/s, such as at least ten (10) gigabits/s.

In particular embodiments, the pluggable connectors described herein may be industrial type connectors that form an environmental seal and are able to withstand harsh weather and vibration or shaking while maintaining a desired transmission rate or performance. Furthermore, the pluggable connectors may obtain desired performance levels while having a limited cross-sectional area where the differential pairs or conductors are arranged with respect to each other. For example, the pluggable connectors may be industrial type M-series connectors where a cross-section of the plug insert or housing cavity is substantially circular. A diameter of a cross-section of the plug insert may be less than about 23 millimeters or, more specifically, less than about 12 millimeters. In alternative embodiments, the pluggable connector has a greater diameter and/or is not substantially circular.

Figure 1:
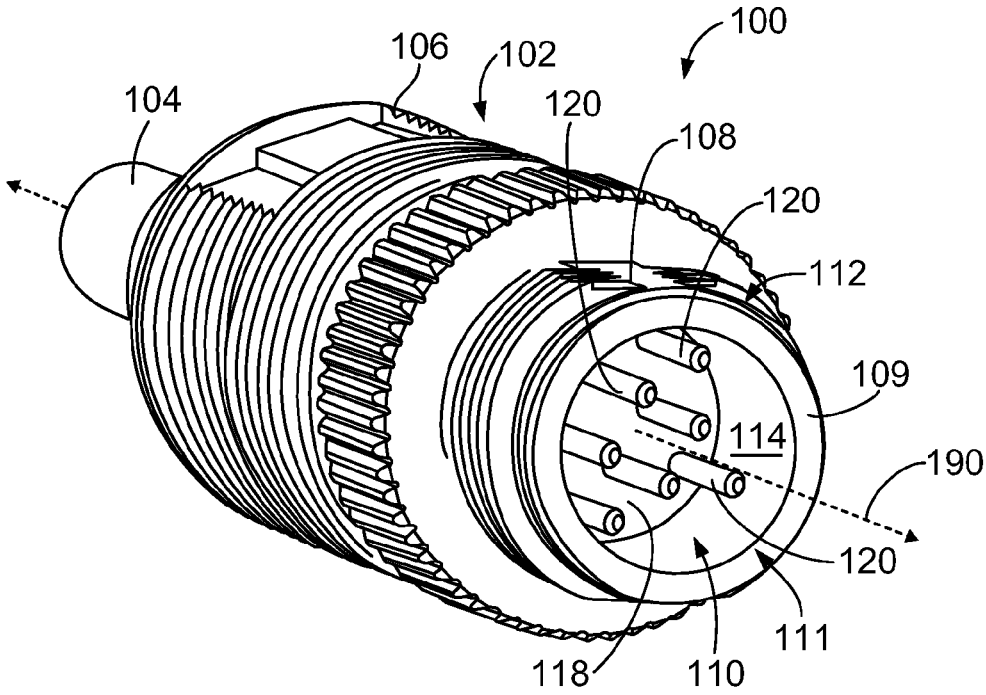
FIG. 1 is a perspective view of a pluggable connector formed in accordance with an embodiment.
Figure 2:
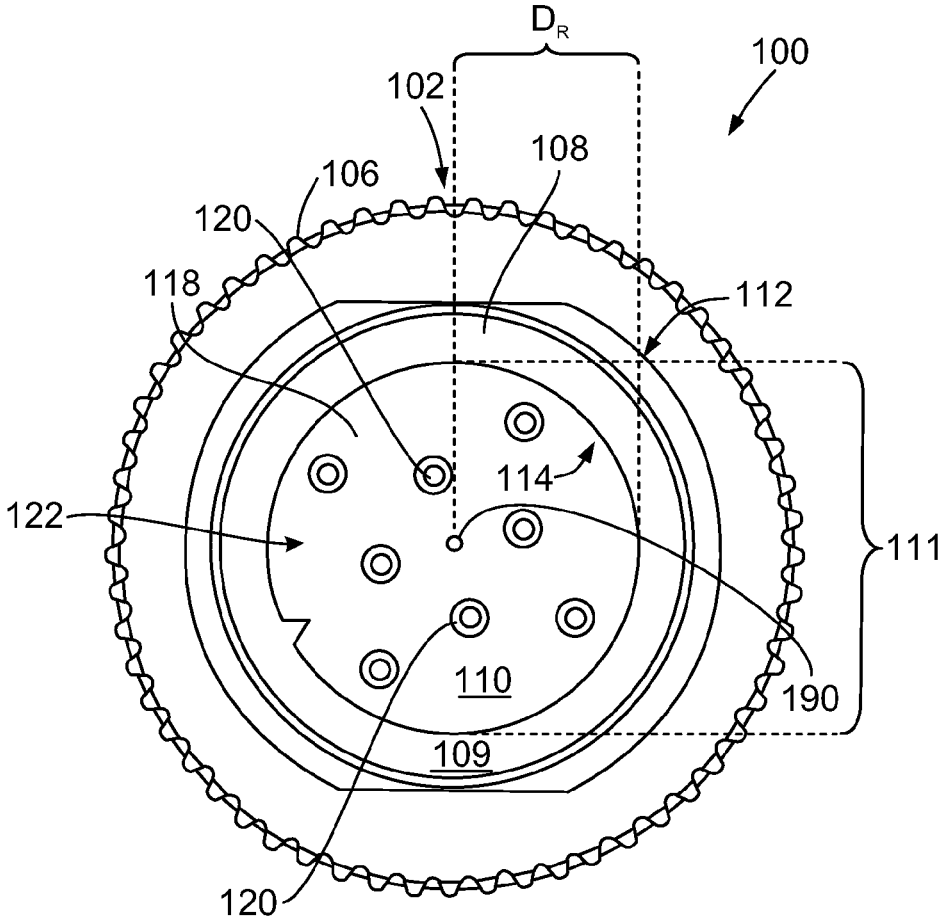
FIG. 2 is a plan view of the pluggable connector shown in FIG. 1.

FIGS. 1 and 2 are perspective and plan views, respectively, of a pluggable connector 100 formed in accordance with an embodiment. The pluggable connector 100 may include a housing 102 that extends along a central axis 190 and is connected to a cable 104 (FIG. 1). The pluggable connector 100 may have a linear structure such that the entire housing 102 extends along the central axis 190. Alternatively, the entire housing 102 might not extend along the central axis 190, but may be shaped as desired. For example, the housing 102 may have a right-angle structure. As shown, the housing 102 includes a body 106 that is connected to the cable 104 and wall 108 that projects from the body 106 and extends along the central axis 190. The wall 108 also extends about or surrounds the central axis 190 to provide a housing cavity 110. The wall 108 forms a front edge 109 that defines an opening 111 of the housing cavity 110. The opening 111 may be sized and shaped to mate with a mating connector, such as the pluggable connector 200 described with reference to FIGS. 3 and 4.

The wall 108 may have a cross-section taken perpendicular to the central axis 190 that is sized and shaped to engage a mating connector. More specifically, the cross-section of the wall 108 may be substantially circular. Furthermore, the housing cavity 110 may be sized and shaped to receive a plug insert from the mating connector. As shown, the wall 108 has an outer surface 112 and an inner surface 114 that defines the housing cavity 110. The outer surface 112 may be configured to fasten to the mating connector. For example, the outer surface 112 may be threaded and configured to engage complementary threads on the inner surface of the mating connector. However, in alternative embodiments, the inner surface 114 may be threaded and be configured to engage complementary threads on an outer surface of the mating connector.

The pluggable connector 100 also includes an organizer or base 118 within the housing cavity 110. The base 118 is configured to support mating contacts 120 and separate the mating contacts 120 from an interior (not shown) of the housing 102. The base 118 may extend along a plane that is perpendicular to the central axis 190. The mating contacts 120 extend from the base 118 toward the opening 111 of the housing cavity 110 and parallel to the central axis 190. The mating contacts 120 may be arranged in a predetermined configuration so that the mating contacts 120 electrically connect with mating contacts (not shown) of the mating connector. As shown in FIGS. 1 and 2, the mating contacts 120 may be pin contacts. However, in other embodiments, the mating contacts 120 may be socket contacts that are configured to receive pin contacts.

Figure 3:
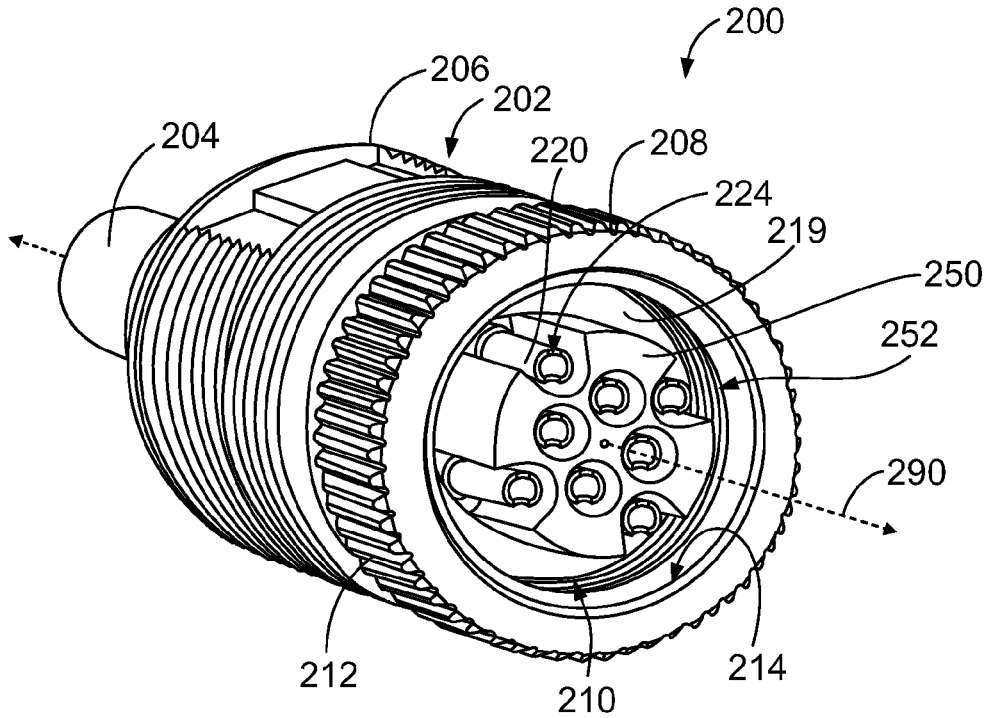
FIG. 3 is a perspective view of a pluggable connector formed in accordance with an embodiment that is configured to mate with the pluggable connector shown in FIG. 1.
Figure 4:
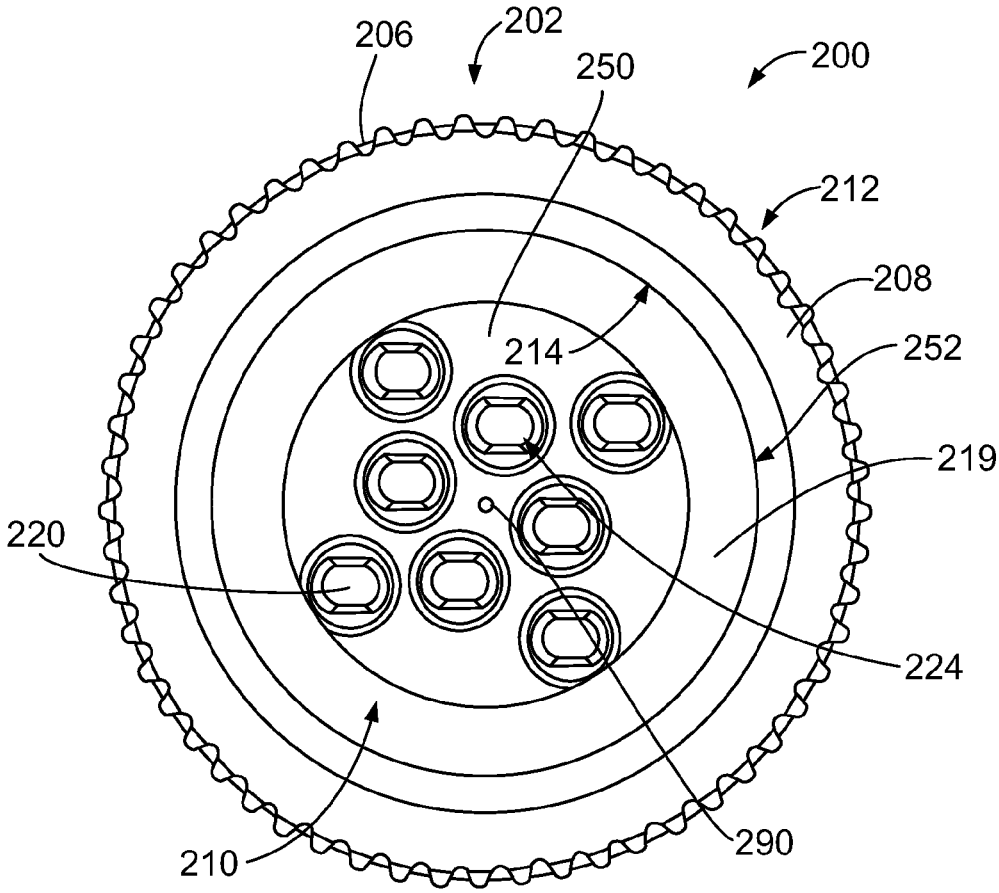
FIG. 4 is a plan view of the pluggable connector shown in FIG. 3.

FIGS. 3 and 4 illustrate a perspective and a plan view, respectively, of a pluggable connector 200 formed in accordance with an embodiment. The pluggable connector 200 may also include a housing 202 that extends along a central axis 290 and is connected to a cable 204 (FIG. 3). The pluggable connector 200 may have a linear structure such that the entire housing 202 extends along the central axis 290. Alternatively, the housing 202 may have other shapes (e.g., right-angle structure). As shown, the housing 202 include a body 206 that is connected to the cable 204 and collar 208 that projects from the body 206 and extends along the central axis 290. The collar 208 also extends about or surrounds the central axis 290 to provide a housing cavity 210. The collar 208 may be rotatably connected to the body 206 such that the collar 208 may be rotated about the central axis 290.

The collar 208 may have a cross-section taken perpendicular to the central axis 290 that is sized and shaped to engage a mating connector, such as the pluggable connector 100 described with reference to FIGS. 1 and 2. More specifically, the cross-section of the collar 208 may be substantially circular. Furthermore, the housing cavity 210 may be sized and shaped to receive the wall 108 (FIG. 1) from the pluggable connector 100. As shown, the collar 208 has an outer surface 212 and an inner surface 214 that defines the housing cavity 210. The outer surface 212 may be configured to be gripped by an operator. For example, the outer surface 112 may have knurling. The inner surface 214 may be threaded and configured to engage or be fastened to the outer surface 112 (FIG. 1) of the wall 108.

Also shown, the pluggable connector 200 may also include a plug insert 250 that surrounds a plurality of mating contacts 220 within the housing cavity 210. The plug insert 250 may have a cross-section (e.g., substantially circular) that is sized and shaped to be inserted into a housing cavity of a mating connector. Furthermore, the plug insert 250 may have an outer surface 251 that faces the inner surface 214 of the collar 208. The inner surface 214 and the outer surface 251 may be separated by (or define therebetween) a spacing 252. The spacing 252 may be sized and shaped to receive the wall 108 (FIG. 1). In FIGS. 3 and 4, the mating contacts 220 are socket contacts configured to receive pin contacts. However, in alternative embodiments, the mating contacts 220 may be pin contacts. Furthermore, the plug insert 250 may be made from a dielectric material that is formed to include a plurality of contact cavities 224 that extend parallel to the central axis 290. The contact cavities 224 are shaped to surround one corresponding mating contact 220. As shown, in some embodiments, the contact cavities 224 may be fully enclosed and have a circular cross-section or the contact cavities 224 may be open-sided (i.e., opening to the inner surface 214 of the collar 208 or to the spacing 252 within the housing cavity 210).

By way of example, when the pluggable connector 200 is fully engaged with the pluggable connector 100, the pluggable connector 200 and the pluggable connector 100 may form at least one of an environmental seal and an electrical shield. For example, the pluggable connector 200 may include a sealing member 219 located a depth into the housing cavity 210. When the pluggable connectors 100 and 200 are engaged, the front edge 109 (FIG. 1) of the wall 108 is inserted into the housing cavity 210. The housing cavity 210 and the wall 108 may have alignment features or be shaped so that the wall 108 and the pluggable connector 100 are in a predetermined orientation before advancing into the housing cavity 210. When the wall 108 is fully inserted, the front edge 109 may compress the sealing member 219.

Figure 5:
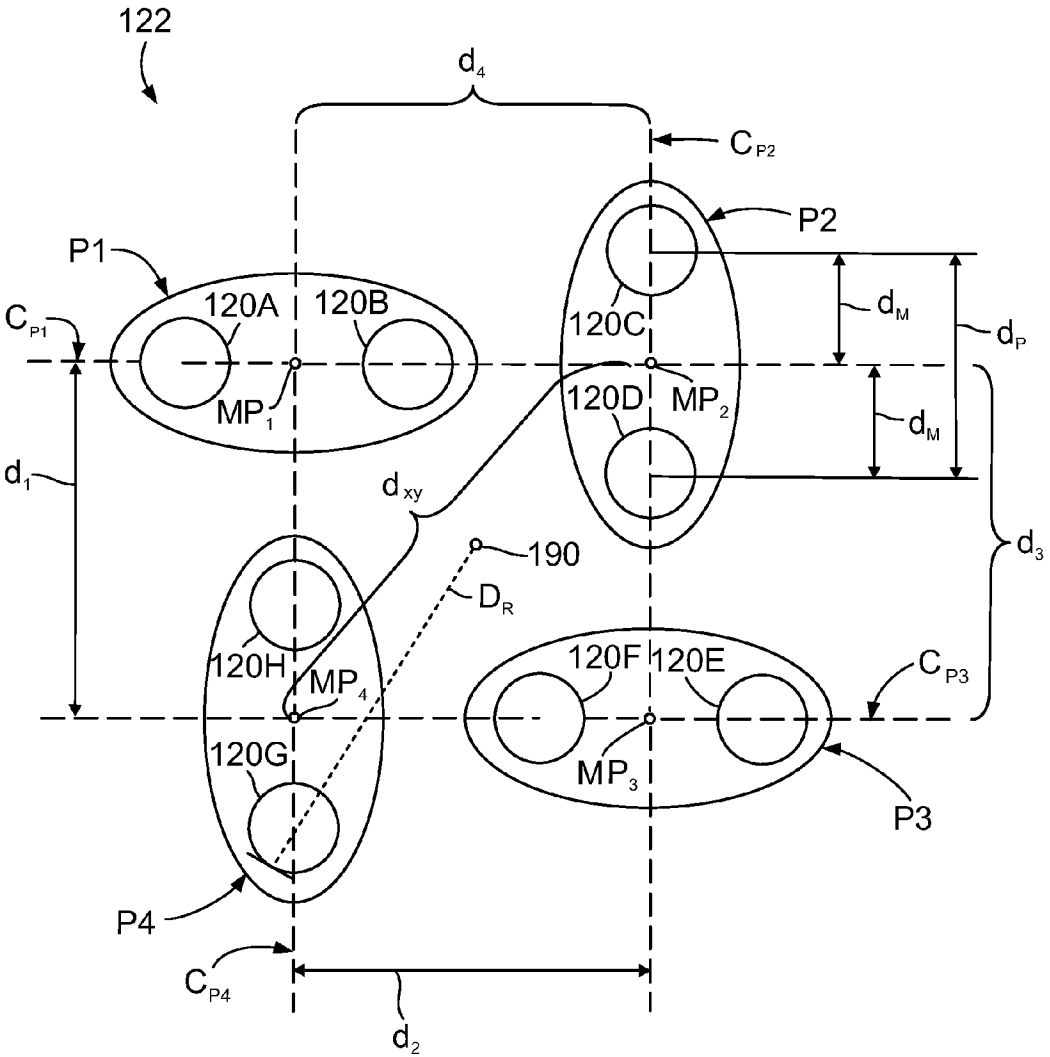
FIG. 5 shows an arrangement of mating contacts that may be used with the pluggable connectors of FIGS. 1 and 3.

FIG. 5 illustrates the array 122 of mating contacts 120 for the pluggable connector 100 (FIG. 1). Although the following is with specific reference to the mating contacts 120 of the array 122, the following description may be similarly applied to the mating contacts 220 (FIG. 3) of the pluggable connector 200 (FIG. 3). However, the mating contacts 220 would be arranged in a mirror image of the mating contacts 122 so that the mating contacts 220 may receive the mating contacts 122 when the pluggable connectors 100 and 200 are engaged. The mating contacts 120 extend parallel to one another and to the central axis 190. As shown in FIG. 5, two mating contacts 120 may form a differential pair P and, in the illustrated embodiment, only four differential pairs P are formed. More specifically, the mating contacts 120A and 1200 form the differential pair P1; the mating contacts 120C and 120D form the differential pair P2; the mating contacts 120E and 120F form the differential pair P3; and the mating contacts 120G and 120H form the differential pair P4. Although not specifically shown, each differential pair P has one mating contact having a positive polarity and another mating contact having a negative polarity.

As shown in FIG. 5, the mating contacts 120 that form a corresponding differential pair P may be adjacent to one another. As used herein, two mating contacts are "adjacent" to one another when the two mating contacts do not have any other mating contact located directly between the two and the two mating contacts are relatively close to one another as compared to other mating contacts. For example, the mating contact 120A is relatively close to the mating contact 120B and 120H, and the mating contact 120D is relatively close to the mating contacts 120C, 120B, 120F, and 120E. In some embodiments, the adjacent mating contacts 120 that make a differential pair P are not closer to any other mating contact 120.

The differential pairs P1-P4 are arranged with respect to each other in order to minimize unwanted electromagnetic coupling between the differential pairs P1-P4. As shown, the two mating contacts 120 of each differential pair P are separated from each other by a distance $d_P$. Furthermore, the two mating contacts 120 of each differential pair P have a midpoint MP therebetween. At the corresponding midpoint MP, each mating contact 120 of the differential pair P is a distance $d_M$ away from the MP of the differential pair. The distances $d_M$ for each mating contact 120 is equal.

Also shown, the two mating contacts 120 of each differential pair P extend parallel to each other along a contact plane $C_P$ of the differential pair P. More specifically, the differential pair P1 has the contact plane $C_{P1}$, the differential pair P2 has the contact plane $C_{P2}$, the differential pair P3 has the contact plane $C_{P3}$, and the differential pair P4 has the contact plane $C_{P4}$. In some embodiments, the contact planes $C_P$ of at least two differential pairs P are perpendicular to one another. FIG. 5 shows a particular embodiment where each of the four differential pairs P1-P4 have a corresponding contact plane $C_P$ that extends perpendicular to the contact planes $C_P$ of two other differential pairs. For example, the contact plane $C_{P3}$ of the differential pair P3 is perpendicular to the contact plane $C_{P2}$ and $C_{P4}$.

Also shown, the contact plane $C_P$ of a differential pair P may be positioned such that the contact plane $C_P$ bisects the distance $d_P$ separating the mating contacts 120 of an adjacent differential pair P (i.e., extends through the corresponding midpoint MP). For example, the contact plane $C_{P1}$ bisects the distance $d_P$ that separates the mating contacts 120C and 120D into two equal distances $d_m$ and $d_m$. In alternative embodiments, the contact plane $C_P$ may be positioned such that the contact plane $C_P$ intersects a mating contact 120 of an adjacent differential pair P or intersects the contact plane $C_P$ of the adjacent differential pair P at a location that is not between the mating contacts 120. Furthermore, the contact plane $C_P$ of one differential pair P may intersect the contact plane $C_P$ of an adjacent differential pair P at a point between the mating contacts 120 of the adjacent differential pair P, but not at the midpoint MP.

Furthermore, the array 122 may be configured to fit within a predetermined cross-sectional area. For example, returning to FIG. 2, the array 122 of mating contacts 120 may be located with respect to each other so that the mating contacts 120 are located within a predetermined radial distance $D_R$ from the central axis 190. The radial distance $D_R$ may be, for example, less than about 13 mm or less than about 6 mm.

Moreover, the midpoints MP of each contact plane $C_P$ may be separated from each other by a distance configured to fit within a limited cross-sectional area while maintaining a desired performance. For example, the midpoint $MP_1$ and $MP_4$ may be separated from each other by a distance $d_1$; the midpoints MP4 and MP3 may be separated from each other by a distance $d_2$; the midpoints MP3 and MP2 may be separated from each other by a distance $d_3$; and the midpoints MP2 and MP1 may be separated from each other by a distance $d_4$. As shown, the distances $d_1$-$d_4$ may be substantially equal (i.e., not differing by more than 5%). Furthermore, midpoints MP located across the central axis 190 from each other may be separated by a distance $d_{XY}$. The distance $d_{XY}$ may be no greater than 1.75 times the longest of the distances $d_1$-$d_4$. More specifically, the distance $d_{XY}$ may be no greater than 1.5 times the longest of the distances $d_1$-$d_4$. Although only one distance $d_{XY}$ is shown that extends between the midpoints MP4 and MP2, another distance $d_{XY}$ may exist between the midpoints MP3 and MP1. The two distances $d_{XY}$ may or may not be equal.

In a particular embodiment, the distances $d_1$-$d_4$ are substantially equal and the distance $d_{XY}$ is no greater than 1.45 times one of the distances $d_1$-$d_4$. However, in other embodiments, the distances $d_1$-$d_4$ might not be substantially equal. For example, at least two of the distances $d_1$-$d_4$ may differ from each other by at least 10%. More specifically, the distances $d_1$ and $d_3$ may be equal, and the distances $d_2$ and $d_4$ may be equal. The distances $d_1$ and $d_3$ may be greater than the distances $d_2$ and $d_4$ by at least 10%. Alternatively, the distances $d_2$ and $d_4$ may be greater than the distances $d_1$ and $d_3$ by at least 10%. In such embodiments where at least two distances differ by at least 10%, the arrangement of differential pairs P may reduce the unwanted electromagnetic coupling between at least two differential pairs. Furthermore, such embodiments may improve at least one of NEXT, far-end crosstalk, insertion loss, and return loss.

Figure 6:
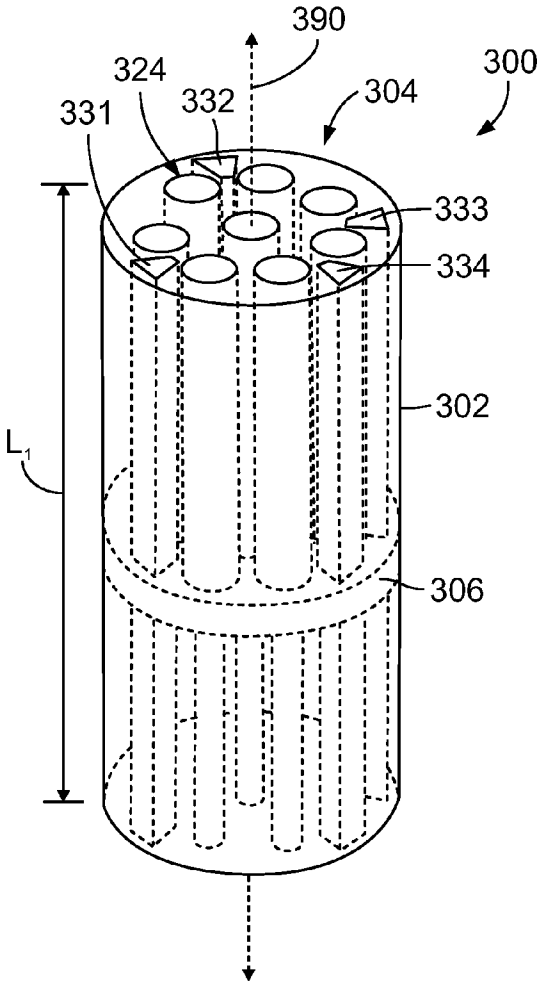
FIG. 6 is a perspective view of a plug insert formed in accordance with another embodiment.
Figure 7:
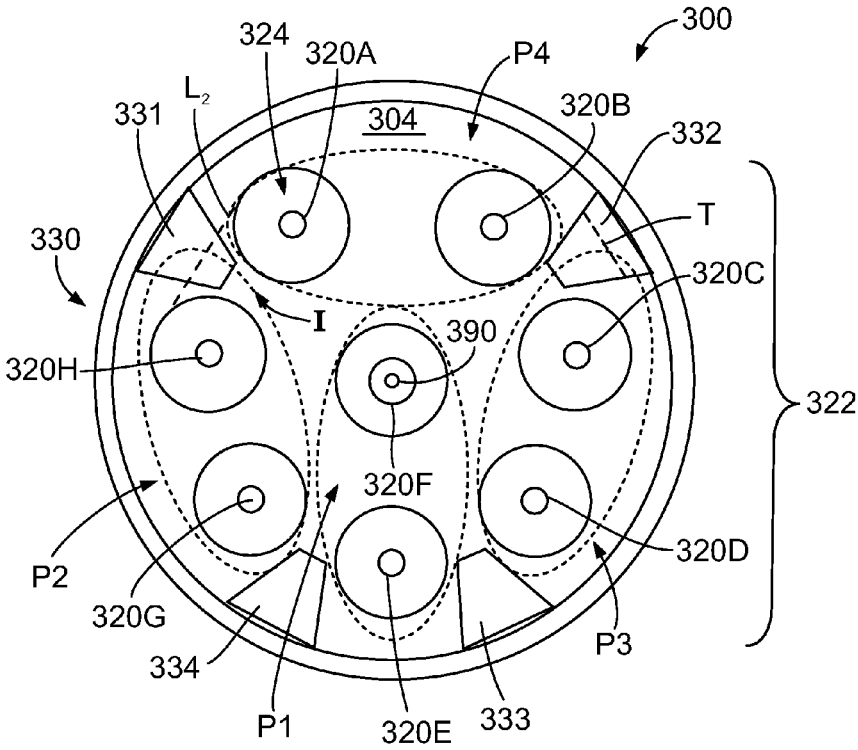
FIG. 7 is a plan view of the plug insert shown in FIG. 6.

FIGS. 6 and 7 are a perspective view and a plan view, respectively, of a plug insert 300 formed in accordance with one embodiment. The plug insert 300 may be located within a housing cavity (not shown) of a pluggable connector (not shown). For example, the plug insert 300 may be located within the housing cavity 210 described above with reference to the pluggable connector 100 in FIG. 3. The plug insert 300 includes a plug body 302 that extends a length $L_1$ (FIG. 6) from a base (not shown) of the pluggable connector to a plug face 304. As shown, the plug body 302 extends along a central axis 390. The plug body 302 is sized and shaped to be inserted into a housing cavity (not shown) of a mating connector. In the illustrated embodiment, the plug body 302 has a cross-section taken perpendicular to the central axis 390 that is substantially circular. However, in alternative embodiments, the cross-section of the plug body 302 may have other geometric shapes, such as a semi-circle, a polygonal shape, and the like. The plug body 302 may be made from a dielectric material.

The plug insert 300 also includes an organizer 306 within the dielectric material. The organizer 306 is configured to support and hold mating contacts 320 (FIG. 7) within contact cavities 324. The organizer 306 may extend along a plane that is perpendicular to the central axis 390. The plurality of mating contacts 320 extend the length $L_1$ of the plug body 302 and parallel to the central axis 390. The contact cavities 324 extend from the organizer 306 to the plug face 304. The mating contacts 320 may be arranged in a predetermined configuration or array 322 (FIG. 7) so that the mating contacts 320 electrically connect with mating contacts (not shown) of the mating connector. As shown in FIG. 7, the mating contacts 320 may be socket contacts. However, in other embodiments, the mating contacts 320 may be pin contacts that are configured to be received in socket contacts of the mating connector.

With reference to FIG. 7, the contact cavities 324 and mating contacts 320 may be arranged into an array 322 of differential pairs P. Two mating contacts 320 may form a differential pair P and, in the illustrated embodiment, only four differential pairs P1-P4 are formed. More specifically, the mating contacts 320A and 320B form the differential pair P1; the mating contacts 320C and 320D form the differential pair P2; the mating contacts 320E and 320F form the differential pair P3; and the mating contacts 320G and 320H form the differential pair P4. Each differential pair P has one mating contact 320 that is a path or has positive polarity where the other mating contact 320 of the differential pair P has a negative polarity. In one embodiment, the mating contacts 320B, 320C, 320E, and 320G are signal paths and the mating contacts 320A, 320D, 320F, and 320H are return paths.

In the illustrated embodiment, the plug insert 300 also includes one or more grounding members 331-334 (also shown in FIG. 6) that extend along the central axis 390. The grounding members 331-334 are located within the plug body 302 and positioned with respect to the mating contacts 320 to improve the performance of the pluggable connector that uses the plug insert 300. For instance, the grounding members 331-334 may be located to improve at least one of insertion loss, NEXT, far-end crosstalk, and return loss. FIG. 7 illustrates one such embodiment that utilizes the grounding members 331-334 to improve performance of the pluggable connector.

As shown, the grounding members 331-334 are positioned proximate to at least two adjacent differential pairs P. More specifically, the grounding member 331 is located proximate to the differential pairs P2 and P4; the grounding member 332 is located proximate to the differential pairs P4 and P3; the grounding member 333 is located proximate to the differential pairs P3 and P1; and the grounding member 334 is located proximate to the differential pairs P1 and P2. In the illustrated embodiment, the grounding members 331-334 are located substantially between the corresponding differential pairs P1-P4. As used herein, the grounding member is "substantially between" the adjacent differential pairs if a portion of the grounding member is directly between two adjacent contact cavities of the adjacent differential pairs. For example, a line $L_2$ drawn from the contact cavity 324 of the mating contact 320A to the contact cavity 324 of the mating contact 320H may intersect a portion of the grounding member 331. However, for a grounding member to be located "proximate to" adjacent differential pairs, the grounding member might not be substantially between the two adjacent contact cavities of the adjacent differential pairs, but may be proximate to an interface 1 of the two adjacent contact cavities.

Also shown in FIG. 7, the plug body 302 may have an outer surface 330 that extends around the central axis 390. The grounding members 331-334 may be located proximate to the outer surface 330. For example, at least one of the grounding members 331-334 may be located closer to the outer surface 330 than any of the contact cavities 324.

Furthermore, the grounding members 331-334 may have cross-sections taken perpendicular to the central axis 390 that have thicknesses T. As shown, the thicknesses T decrease or taper as the corresponding grounding member 331-334 extends toward the central axis 390. For example, the grounding members 331-334 may have a wedge or frustro-conical cross-sectional shape. Alternatively, the grounding members 331 may have other cross-sectional shapes and might not taper as the grounding member extends toward the central axis 390. For example, the grounding member may have a circular cross-sectional shape or the thickness T may increase as the thickness extends toward the central axis 390.

Figure 8:
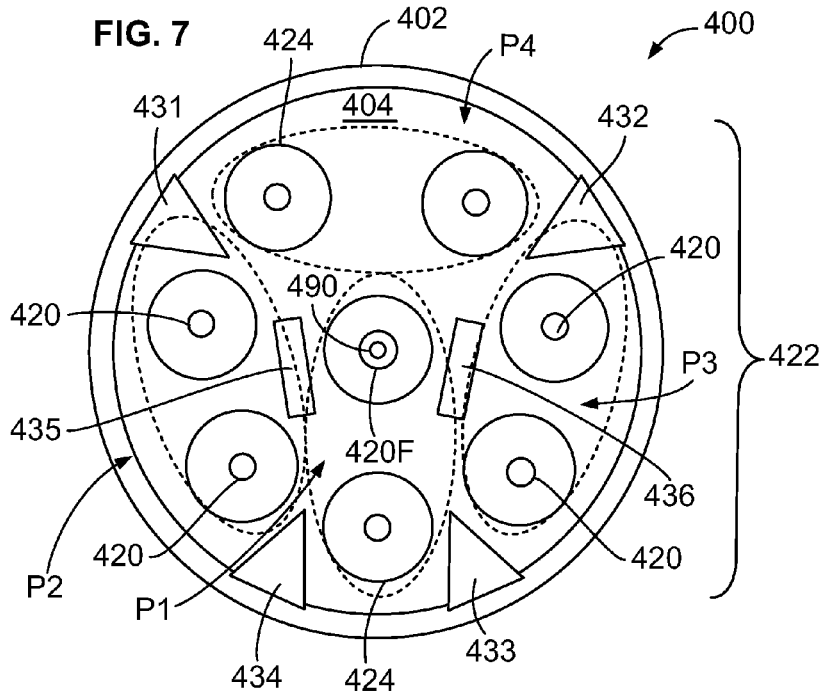
FIG. 8 is a plan view of a plug insert formed in accordance with another embodiment.

FIG. 8 is a plan view of a plug insert 400 formed in accordance with another embodiment. The plug insert 400 may have similar features and components as described with respect to the plug insert 300 in FIGS. 6 and 7. For example, the plug insert 400 has a plug body 402 that includes a plug face 404. The plug face 404 has a center through which a central axis 490 of the plug body 402. Furthermore, the plug insert 400 has an array 422 of contact cavities 424 having mating contacts 420 therein. The array 422 is similarly arranged as the array 322 shown in FIG. 7 and includes differential pairs P1-P4. The plug insert 400 may also include grounding members 431-434 that are located in similar positions as the grounding members 331-334 (FIG. 7).

However, in addition to the grounding members 431-434, the plug insert 400 may also have grounding members 435 and 436 that are located between adjacent differential pairs P in a center region of the plug body 402. More specifically, the grounding member 435 may be located between a mating contact 420F of the differential pair P1 that has the central axis 490 extending therethrough and a mating contact 420 of the differential pair P2. The grounding member 436 may be located between the mating contact 420F of the differential pair P1 and a mating contact 420 of the differential pair P3. Similar to above, the grounding members 435 and 436 may have a cross-sectional shape that is configured to improve the performance of the corresponding pluggable connector. For example, as shown in FIG. 8, the grounding members 435 and 436 have thin, rectangular cross-sectional shapes. Also shown, the grounding members 431-434 may have triangular cross-sectional shapes.

Figure 9:
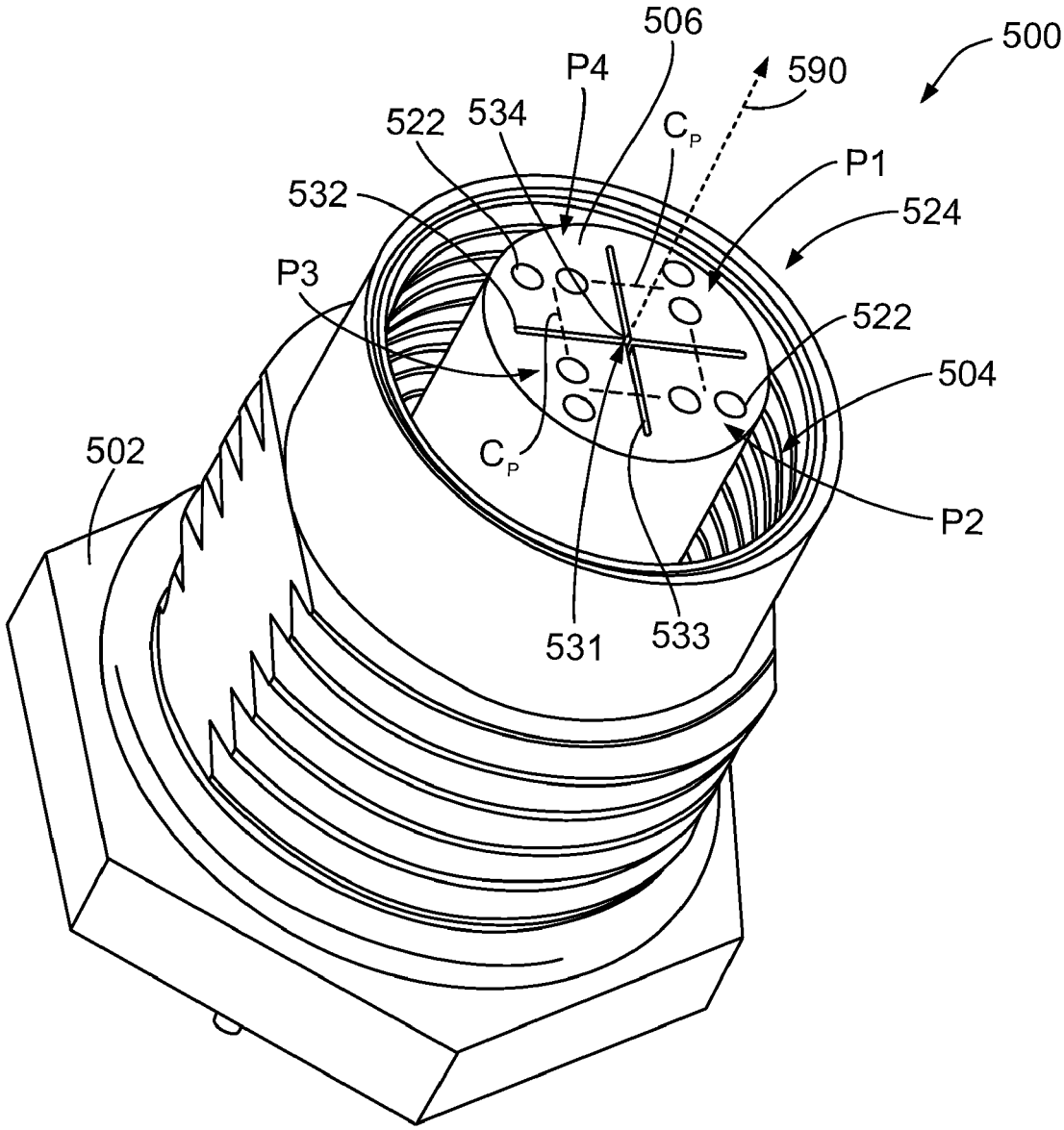
FIG. 9 is a perspective view of a pluggable connector formed in accordance with an alternative embodiment.

FIG. 9 is a perspective view of a pluggable connector 500 formed in accordance with an alternative embodiment that utilizes features of the pluggable connector 100 (FIG. 1) and the plug inserts 300 (FIG. 6) and 400 (FIG. 8). The pluggable connector 500 includes a housing 502 that has a housing cavity 504 where a plug insert 506 is located. The housing cavity 504 and the plug insert 506 extend along a central axis 590 of the pluggable connector 500. The plug insert 506 includes an array 524 of contact cavities 522 that have mating contacts (not shown) therein. The contact cavities 522 and corresponding mating contacts form differential pairs P1-P4. The differential pairs P1-P4 each have a contact plane $C_P$ that the two mating contacts of the corresponding differential pair P extend along. As shown, the contact planes $C_P$ may extend perpendicular to at least one other contact plane $C_P$. More specifically, the pluggable connector 500 includes only four differential pairs P1-P4 where each differential pair P extends along a corresponding contact plane $C_P$ that extends perpendicular to two contact planes $C_P$ of two adjacent differential pairs P.

Also shown, the pluggable connector 500 includes a grounding member 531, which is shown as a cross-shaped structure having two legs 532 and 533 that intersect each other at a point 534. The central axis 590 of the pluggable connector 500 extends through the point 534. Accordingly, embodiments described herein may utilize a particular arrangement of differential pairs and grounding members to obtain a desired performance.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A pluggable connector comprising:

a housing having an inner surface that defines a housing cavity that includes a base therein, the housing cavity extending along a central axis from the base to an opening of the housing cavity that is sized and shaped to mate with a mating connector moving along the central axis;

a plug insert positioned within the housing cavity, the plug insert extending from the base along the central axis and forming contact cavities therein that extend parallel to the central axis; and first and second differential pairs extending from the base along the central axis within the housing cavity, each of the first and second differential pairs comprising two mating contacts extending parallel to each other along a contact plane of the respective differential pair and within corresponding contact cavities, the two mating contacts being separated by a gap, the contact planes of the first and second differential pairs being perpendicular to one another, wherein the contact plane of the first differential pair extends through the gap that separates the two mating contacts of the second differential pair.

2. The pluggable connector in accordance with claim 1 further comprising a third differential pair comprising two mating contacts extending parallel to each other along a contact plane of the third differential pair, wherein the contact plane of the first differential pair is perpendicular to the second and third differential pairs.

3. The pluggable connector in accordance with claim 1 wherein the two mating contacts of each differential pair are adjacent to one another.

4. The pluggable connector in accordance with claim 1 wherein one contact of each differential pair is located a common radial distance from the central axis.

5. The pluggable connector in accordance with claim 1 wherein the plug insert has a substantially circular cross-sectional shape.

6. The pluggable connector in accordance with claim 1 wherein the plug insert has an outer surface that faces and is separated from the inner surface of the housing by a spacing, wherein at least one of the contact cavities is open-sided along the central axis such that the contact cavity opens to the spacing between the inner and outer surfaces.

7. The pluggable connector in accordance with claim 1 further comprising a grounding member extending parallel to the central axis, the grounding member being positioned substantially between the first and second differential pairs.

8. The pluggable connector in accordance with claim 1 wherein the differential pairs are located with respect to each other to operate at a speed of at least one gigabit/s.

9. The pluggable connector in accordance with claim 1 further comprising third and fourth differential pairs that each have two mating contacts extending parallel to each other along a corresponding contact plane, the contact planes of the third and fourth differential pairs being perpendicular to one another.

10. The pluggable connector in accordance with claim 9 wherein each contact plane of the differential pairs extends between the two mating contacts of an adjacent differential pair.

11. The pluggable connector in accordance with claim 9 wherein the differential pairs comprise only the first, second, third, and fourth differential pairs.

12. The pluggable connector in accordance with claim 1 further comprising third and fourth differential pairs that each have two mating contacts extending parallel to each other along a corresponding contact plane, the two mating contacts being separated by a corresponding gap, wherein the contact plane of the third differential pair extends through the gap that separates the two mating contacts of the fourth differential pair.

13. The pluggable connector in accordance with claim 1 wherein the gap separates the two mating contacts by a distance, the contact plane of the first differential pair substantially bisecting the distance separating the two mating contacts of the second differential pair.

14. A pluggable connector configured to mate with a mating connector, the pluggable connector comprising:

a plug insert extending along a central axis and forming contact cavities therein, the contact cavities extending parallel to the central axis;

differential pairs extending along the central axis in the plug insert, each differential pair comprising two mating contacts extending parallel to each other and within corresponding contact cavities; and a grounding member extending parallel to the central axis, the grounding member being positioned proximate to at least two adjacent differential pairs to improve electrical performance; and wherein the grounding member has a cross-section taken perpendicular to the central axis, the cross-section of the grounding member having a thickness that at least one of increases and decreases as the grounding member extends toward the central axis.

15. The pluggable connector in accordance with claim 14 wherein the thickness decreases as the grounding member extends toward the central axis.

16. The pluggable connector in accordance with claim 14 wherein the plug insert has an outer surface, the grounding member being located proximate to the outer surface.

17. The pluggable connector in accordance with claim 14 wherein the grounding member is positioned substantially between the adjacent differential pairs.

18. The pluggable connector in accordance with claim 14 wherein the grounding member has a substantially wedge or frustro-conical cross-sectional shape.

19. A pluggable connector configured to mate with a mating connector, the pluggable connector comprising:

a plug insert extending along a central axis and forming contact cavities therein, the contact cavities extending parallel to the central axis;

differential pairs extending along the central axis in the plug insert, each differential pair comprising two mating contacts extending parallel to each other and within corresponding contact cavities; and a grounding member extending parallel to the central axis, the grounding member being positioned proximate to at least two adjacent differential pairs to improve electrical performance;

wherein one mating contact extends through a center of the plug insert such that the central axis extends directly therethrough, the grounding member being located proximate to the mating contact extending through the center.

20. The pluggable connector in accordance with claim 14 wherein the two mating contacts of each differential pair extend along a contact plane of the differential pair, the contact planes of at least two adjacent differential pairs being perpendicular to one another.

* * * * *